US007326677B2

(12) United States Patent
Delplancke et al.

(10) Patent No.: US 7,326,677 B2
(45) **Date of Patent: *Feb. 5, 2008**

(54) LIQUID LAUNDRY DETERGENT COMPOSITIONS COMPRISING A SILICONE BLEND OF NON-FUNCTIONALIZED AND AMINO-FUNCTIONALIZED SILICONE POLYMERS

(75) Inventors: Patrick Firmin August Delplancke, Laarne (BE); Jean-Pol Boutique, Gembloux (BE); Stefano Scialla, Rome (IT); Gregory Leo Jervier, Cincinnati, OH (US); Connie Lynn Sheets, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 115 days.

This patent is subject to a terminal disclaimer.

(21) Appl. No.: 10/884,286

(22) Filed: Jul. 2, 2004

(65) Prior Publication Data

US 2005/0009721 A1 Jan. 13, 2005

Related U.S. Application Data

(60) Provisional application No. 60/486,558, filed on Jul. 11, 2003.

(51) Int. Cl.
*C11D 9/36* (2006.01)
*C11D 3/386* (2006.01)

(52) U.S. Cl. ..... 510/466; 510/276; 510/285; 510/287; 510/400; 510/300; 510/304; 510/371; 510/394; 510/407; 510/417; 510/305; 510/320; 510/374; 510/392

(58) Field of Classification Search ..... 510/466, 510/276, 285, 287, 400, 300, 304, 371, 394, 510/407, 417, 305, 320, 374, 392
See application file for complete search history.

(56) References Cited

U.S. PATENT DOCUMENTS

| | | | | |
|---|---|---|---|---|
| 4,639,321 | A | 1/1987 | Barrat et al. | |
| 5,080,824 | A | 1/1992 | Bindl et al. | |
| 5,091,105 | A | 2/1992 | Madore et al. | |
| 5,866,532 | A * | 2/1999 | Jackson et al. | 510/466 |
| 6,117,830 | A * | 9/2000 | Yokosuka et al. | 510/242 |
| 6,258,130 | B1 * | 7/2001 | Murphy | 8/142 |
| 6,432,420 | B2 * | 8/2002 | Ellis et al. | 424/401 |
| 6,506,715 | B1 * | 1/2003 | Schultz et al. | 510/189 |
| 6,548,465 | B2 * | 4/2003 | Perry et al. | 510/285 |
| 6,623,530 | B2 * | 9/2003 | Murphy | 8/142 |
| 6,833,344 | B2 * | 12/2004 | Boutique et al. | 510/330 |
| 6,972,279 | B2 * | 12/2005 | Deak et al. | 510/466 |
| 2001/0000467 | A1 | 4/2001 | Unilever | |
| 2002/0174493 | A1 * | 11/2002 | Perry et al. | 8/142 |
| 2002/0182161 | A1 * | 12/2002 | Ainger et al. | 424/70.12 |
| 2003/0060396 | A1 * | 3/2003 | Deak et al. | 510/511 |
| 2003/0084519 | A1 * | 5/2003 | Yang | 8/405 |
| 2003/0104968 | A1 * | 6/2003 | Deak et al. | 510/466 |
| 2004/0087464 | A1 * | 5/2004 | Stoessel et al. | 510/407 |
| 2004/0088795 | A1 * | 5/2004 | Orchowski et al. | 8/142 |
| 2004/0092425 | A1 * | 5/2004 | Boutique et al. | 510/466 |
| 2004/0266653 | A1 * | 12/2004 | Delplancke et al. | 510/470 |

FOREIGN PATENT DOCUMENTS

| | | |
|---|---|---|
| EP | 0 150 872 | 8/1985 |
| EP | 0 658 1000 B1 | 6/1995 |
| EP | 1 080 714 | 3/2001 |
| WO | 99/62462 | * 12/1999 |
| WO | WO 99/62462 | 12/1999 |
| WO | WO 00/70005 | 11/2000 |

* cited by examiner

*Primary Examiner*—Charles Boyer
(74) *Attorney, Agent, or Firm*—Armina E. Matthews; Julie A. McConihay; Kim William Zerby

(57) ABSTRACT

The invention is directed to liquid laundry detergent compositions for treating non-keratinous substrates under domestic wash conditions, such composition comprise (A) at least one surfactant selected from the group consisting of anionic surfactants, nonionic surfactants, zwitterionic surfactants, amphoteric surfactants, and combinations thereof; (B) a silicone blend comprising a non-functionalized silicone and a functionalized silicone; and (C) at least one additional non-silicone laundry adjunct selected from the group consisting of detergent builders, detersive enzymes, dye transfer inhibiting agents, and combinations thereof. The claimed compositions are further essentially free of any coacervate phase-forming polymer and essentially free of any cationic deposition aid.

17 Claims, No Drawings

LIQUID LAUNDRY DETERGENT COMPOSITIONS COMPRISING A SILICONE BLEND OF NON-FUNCTIONALIZED AND AMINO-FUNCTIONALIZED SILICONE POLYMERS

CROSS REFERENCE TO RELATED PATENT APPLICATIONS

This application is based on the U.S. Provisional Application having Ser. No. 60/486,558, flied July 11, 2003 in the names of Patrick Finnin August Delplancke, Jean-Pol Boutique, Stefano Scialla, Gregory Leo Jervier and Connie Lynn Sheets.

FIELD OF THE INVENTION

This invention relates to liquid laundry detergent compositions and to non-keratinous substrates treated with such liquid laundry detergent compositions.

BACKGROUND OF THE INVENTION

When consumers launder fabrics, they desire not only excellence in cleaning, they also seek to impart superior fabric care benefits. Such fabric care effects can be exemplified by one or more of reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; anti-abrasion benefits; anti-pilling benefits; or any combination thereof. Compositions which provide both cleaning benefits and additional fabric care benefits, e.g., fabric softening benefits, are known as "2 in 1"-detergent compositions and/or as "softening through the wash"-compositions.

Due to the incompatibility of anionic detersive surfactants and many cationic fabric care agents, e.g., fabric softening agents, in liquid detergent compositions, the detergent industry has formulated alternative compositions. These compositions provide both fabric cleaning and additional fabric care benefits. The alternative compositions contain anionic detersive surfactants and additional non-cationic fabric care agents which are not rendered inefficient by the incompatability of anionic detersive surfactants and cationic fabric care agents. Examples of non-cationic fabric softening agents are clays and silicones. Polydialkylpolysiloxane- and aminosilicone-based compounds have been identified as beneficial non-cationic fabric care agents in "2 in 1"-detergent compositions. EP 0 150 872 (P&G, published Aug. 7, 1985) describes a liquid detergent composition comprising an anionic, nonionic, amphoteric and/or zwitterionic surface-active agent(s) and an organo-functional poly-di-alkyl siloxane treatment agent having a specific formula.

In contrast to conventional cationic fabric care agents, the deposition characteristics of the above described non-cationic fabric care agents on typically anionically charged fabrics and textiles are such that the amount deposited is very low. In order to overcome this drawback, deposition aids have often been added into "2 in 1"-detergent compositions. Suitable deposition aids are typically cationically charged and/or have a high molecular weight. Examples of well known cationic deposition aids are cationic guar gums, and poly-quaternary ammonium compounds. WO 00/70 005 (Unilever, published Nov. 23, 2000) describes fabric softening compositions comprising a nonionic fabric softening agent, an anionic surfactant and a cationic polymer added for the purpose of improving the deposition of the softening agent onto the fabric. EP 0 658 100 B1 (Unilever, published Jun. 21, 1995) describes liquid detergent compositions comprising a non-soap detergent, a cationic polymer and a silicone. EP 1 080 714 (Johnson&Johnson, published Mar. 7, 2001) describes "2 in 1"-detergent compositions with enhanced depositing, conditioning and softness capabilities, comprising a water-soluble silicone agent, at least one cationic conditioning agent, and at least one detergent.

Unfortunately, it has been found that the incorporation of cationic deposition aids also brings with it several drawbacks. Cationic deposition aids can significantly alter cleaning benefits during the washing process. Indeed, it has been found that fabrics being laundered with a cationic deposition aid-containing liquid detergent composition can exhibit reduced whiteness. Without being bound by theory, it is believed that the reduced whiteness occurs because the deposition aids present in the wash liquor can drag suspended soils onto the clothes. Those soils then reduce the cleaning benefit previously achieved by the detersive ingredients of the composition. It has been further found that cationic deposition aids can entrain dyes and contribute to the redeposition of dissolved dyes onto fabrics. This effect is particularly problematic when colored fabrics are laundered together with white fabrics in the same wash cycle.

Cationic deposition aids frequently form coacervating phases either in the fully formulated detergent composition and/or in the wash liquor wherein the detergent composition has been diluted with a diluent, typically with water. Thus, all what was said hereinbefore for cationic deposition aids also applies for coacervate phase-forming polymers.

In light of the forgoing, there is a continuing need to solve the hereinbefore mentioned technical problems and to provide compositions which exhibit superior fabric cleaning and superior fabric care in home laundering operations without the drawbacks identified above. One approach would, of course, include the elimination of cationic deposition aids for avoid the problem they can cause. However, as mentioned above, one still need to ensure satisfactory deposition of the non-cationic fabric softening silicone compounds. There is therefore a need for liquid laundry detergent compositions providing improved cleaning and additional fabric care benefits in a regular wash cycle in the absence of cationic deposition aids. In particular, there remain important unsolved problems with respect to selecting compatible fabric care and fabric cleaning ingredients so that the combination of both provides uncompromising levels of fabric cleaning and fabric care. Furthermore, it remains particularly difficult to combine anionic surfactants and non-cationic fabric care beneficial agents in the absence of cationic deposition aids in such a way as to secure superior fabric care at the same time as outstanding cleaning and product formulation stability and formulation flexibility.

Accordingly, it is an object of the present invention to address the hereinbefore mentioned technical problems by providing compositions which comprise detersive surfactants and non-cationic fabric care agents surfactants with such compositions at the same time being essentially free of cationic deposition aids. Such compositions have been found to provide superior fabric cleaning and superior fabric care.

One embodiment of the present invention is an essentially cationic deposition aid-free liquid laundry detergent composition comprising at least one detersive surfactant, at least one detergent adjunct, and a blend of silicone materials. Of particular importance is the selection of suitable silicone materials. The selected combination of specific type of silicone ingredients has been found to provide superior fabric cleaning and superior fabric care benefits.

Moreover, superior fabric care or garment care benefits in home laundering as discovered in connection with the present invention unexpectedly include benefits when the products herein are used in different modes, such as treatment before washing in an, optionally automatic, washing machine, and through-the wash benefits as well as treatment by hand wash. Additionally discovered are regimen benefits, i.e., benefits of converting from use of a product system comprising conventional detergents to a product system comprising use of the present compositions and compositions formulated specifically for use therewith. In particular, it has been found that the combination of at least one detersive surfactant, at least one detergent adjunct, and a blend of silicone materials in the absence of cationic deposition aids provides synergistic effects for fabric cleaning and fabric care. This is particularly true for fabric softening benefits, for color care benefits, for anti-abrasion benefits, and for anti-pilling benefits or any combination thereof, imparted to fabrics which have been treated with the liquid laundry detergent compositions of the present invention.

SUMMARY OF THE INVENTION

The present invention relates to liquid laundry detergent compositions for treating non-keratinous substrates under domestic wash conditions, such composition comprises (A) at least one surfactant selected from the group consisting of anionic surfactants, nonionic surfactants, zwitterionic surfactants, amphoteric surfactants, and combinations thereof;

(B) a silicone blend comprising a non-functionalised silicone and a functionalised silicone; and, (C) at least one additional non-silicone laundry adjunct selected from the group consisting of detergent builders; detersive enzymes; dye transfer inhibiting agents, and combinations thereof;

wherein the composition is further essentially free of any coacervate phase-forming polymer and essentially free of any cationic deposition aid.

The present invention is further directed to non-keratinous substrates treated with a liquid laundry detergent composition of the present invention. In a preferred embodiment, a certain amount of the silicone blend provided by the liquid laundry detergent composition of the present invention, has been deposited on such a non-keratinous substrate. The amount of silicone deposited is preferably at least 0.001 mg silicone per gram of non-keratinous substrate, more preferably between 0.1 mg silicone per gram of non-keratinous substrate and 500 mg silicone per gram of non-keratinous substrate, even more preferably between 0.125 mg silicone per gram of non-keratinous substrate and 10 mg silicone per gram of non-keratinous substrate, and most preferably between 0.150 mg silicone per gram of non-keratinous substrate and 1.0 mg silicone per gram of non-keratinous substrate.

DETAILED DESCRIPTION OF THE INVENTION

A, Surfactants—The present compositions comprise as one essential component at least one surfactant selected from the group consisting anionic surfactants, nonionic surfactants, zwitterionic surfactants, amphoteric surfactants, and combinations thereof. Suitable concentrations of this component are in the range from 10% to 80%, preferably from 20% to 65%, and more preferably from 25% to 45%, by weight of the composition.

By nature, every anionic surfactant, nonionic surfactant, zwitterionic surfactant, amphoteric surfactant, and combinations thereof, as known in the art of detergent compositions may be used, such as disclosed in "Surfactant Science Series", Vol. 7, edited by W. M. Linfield, Marcel Dekker. Non-limiting examples of other anionic, nonionic, zwitterionic, amphoteric or optional additional surfactants suitable for use in the compositions are described in McCutcheon's, Emulsifiers and Detergents, 1989 Annual, published by M. C. Publishing Co., and in U.S. Pat. Nos. 5,104,646; 5,106,609; 3,929,678; 2,658,072; 2,438,091; and 2,528,378.

B, Silicone blend—The present compositions will essentially contain a silicone blend comprising a non-functionalised silicone and a functionalised silicone. Suitable concentrations of the blend in the compositions of the present invention are from 0.05% to 10%, preferably from 0.1% to 5.0%, more preferably from 0.25% to 3.0%, and most preferably from 0.5% to 2.0%, by weight of the composition. The weight ratio of the non-functionalised silicone and the functionalized silicone within the blend ranges from 100:1 to 1:100, preferably from 25:1 to 1:5, more preferably from 20:1 to 1:1, and most preferably from 15:1 to 2:1.

(b1) Non-functionalised silicones:

For purposes of this invention, a non-functionalised silicone is a polymer containing repeating SiO groups and substitutents which comprise of carbon, hydrogen and oxygen. Thus, the non-functionalized silicones selected for use in the compositions of the present invention include any nonionic, non-cross linked, nitrogen-free silicone polymer.

Preferably, the non-functionalized silicone is selected from nonionic nitrogen-free silicone polymers having the formulae (I) to (III):

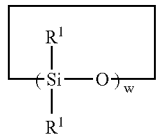

(I)

$$R^2—(R^1)_2SiO—[(R^1)_2SiO]_a—[(R^1)(R^2)SiO]_b—Si(R^1)_2—R^2 \quad \text{(II)}$$

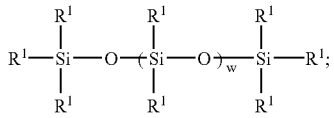

(III)

and combinations thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and combinations thereof; each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide)copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy)copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer is between 0.01 $m^2/s$ (10,000 centistokes at 20° C.) to 2.0 $m^2/s$ (2,000,000 centistokes at 20° C.), preferably from 0.1 $m^2/s$ (100,000 centistokes at 20° C.) to 1.0 $m^2/s$ (1,000,000 centistokes at 20° C.), more preferably from 0.3 $m^2/s$ (300,000 centistokes at 20° C.) to 0.8 $m^2/s$ (800,000 centistokes at 20° C.), and most preferably from 0.55 $m^2/s$ (550,000 centistokes at 20° C.) to 0.7 $m^2/s$ (700,000 centistokes at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the non-functionalized silicone is selected from linear nonionic silicones having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above; a is from 1 to 30, b is from 1 to 30, n is from 3 to 5, total c is from 6 to 100, total d is from 0 to 3, and total c+d is from 7 to 100 and wherein the index w has the value as such that the viscosity of the non-functionalized silicone is from 0.01 $m^2/s$ (10,000 centistokes at 20° C.) to 2.0 $m^2/s$ (2,000,000 centistokes at 20° C.), preferably from 0.1 $m^2/s$ (100,000 centistokes at 20° C.) to 1.0 $m^2/s$ (1,000,000 centistokes at 20° C.), more preferably from 0.3 $m^2/s$ (300,000 centistokes at 20° C.) to 0.8 $m^2/s$ (800,000 centistokes at 20° C.), and most preferably from 0.55 $m^2/s$ (550,000 centistokes at 20° C.) to 0.7 $m^2/s$ (700,000 centistokes at 20° C.).

Most preferably, the non-functionalised silicone is selected from linear nonionic nitrogen-free silicone polymers having the formula (III) as above, wherein $R^1$ is methyl and wherein the index w has the value as such that the viscosity of the nitrogen-free silicone polymer of formula (III) is from 0.01 $m^2/s$ (10,000 centistokes at 20° C.) to 2.0 $m^2/s$ (2,000,000 centistokes at 20° C.), preferably from 0.1 $m^2/s$ (100,000 centistokes at 20° C.) to 1.0 $m^2/s$ (1,000,000 centistokes at 20° C.), more preferably from 0.3 $m^2/s$ (300,000 centistokes at 20° C.) to 0.8 $m^2/s$ (800,000 centistokes at 20° C.), and most preferably from 0.55 $m^2/s$ (550,000 centistokes at 20° C.) to 0.7 $m^2/s$ (700,000 centistokes at 20° C.).

Non-limiting examples of nitrogen-free silicone polymers of formula (II) are the Silwet® compounds which are available from OSI Specialties Inc., a Division of Witco, Danbury, Conn., U.S.A. Non-limiting examples of nitrogen-free silicone polymers of fomula (I) and (III) are the Silicone 200 fluid series from Dow Coming.

(b2) Functionalised Silicones:

For purpose of the present invention, a functionalised silicone is a polymer containing repeating SiO groups and substitutents which comprise at least one nitrogen, sulfur or phosphor atom. Preferably, the functionalized silicones selected for use in the compositions of the present inventions include amino-functionalized silicones, i.e., a silicone containing at least one primary amine, secondary amine, or tertiary amine. Quaternized amino-functionalized silicones, i.e. quaternary ammonium silicones, are also enclosed in the definition of functionalised silicones for the purpose of the present invention. Preferred functionalized silicones have a % amine/ammonium functionality in the range of from 0.01% to 10%, preferably of from 0.05% to 1%, and more preferably of from 0.3% to 0.5%. Other types of functionalised silicones preferably have a % amine/ammonium functionality in the range of from 0.05% to 0.3%. Typically, the functionalized silicone has a viscosity from 0.0001 $m^2/s$ (100 centistokes at 20° C.) to 2.0 $m^2/s$ (2,000,000 centistokes at 20° C.), preferably from 0.01 $m^2/s$ (10,000 centistokes at 20° C.) to 0.1 $m^2/s$ (100,000 centistokes at 20° C.), and most preferably from 0.02 $m^2/s$ (20,000 centistokes at 20° C.) to 0.08 $m^2/s$ (80,000 centistokes at 20° C.).

In general, any functionalized silicone can be used in the present invention including anionically charged functionalized silicones, cationically charged functionalized silicones, zwitterionic functionalized silicones, amphoteric functionalized silicones, and combinations thereof Suitable cationically charged functionalized silicones are disclosed in the Applicant's co-pending applications WO 02/018528 and EP 02 447 167.4.

Examples of a preferred functionalized silicones for use in the compositions of the present invention include but are not limited to, those which conform to the general formula (V):

$$(R^1)_aG_{3-a}\text{-}Si—(—OSiG_2)_n\text{-}(—OSiG_b(R^1)_{2-b})_m—O—SiG_{3-a}(R^1)_a \quad (V)$$

wherein G is hydrogen, phenyl, hydroxy, or $C_1$-$C_8$ alkyl, preferably methyl; a is 0 or an integer having a value from 1 to 3, preferably 1; b is 0, 1 or 2, preferably 1; n is a number from 0 to 1,999, preferably from 49 to 500; m is an integer from 1 to 2,000, preferably from 1 to 10; the sum of n and m is a number from 1 to 2,000, preferably from 50 to 500; $R^1$ is a monovalent radical conforming to the general formula $C_qH_{2q}L$, wherein q is an integer having a value from 2 to 8 and L is selected from the following groups: $—N(R^2)CH_2—CH_2—N(R^2)_2$; $—N(R^2)_2$; wherein $R^2$ is hydrogen, phenyl, benzyl, or a saturated hydrocarbon radical, preferably an alkyl radical of from $C_1$ to $C_{20}$.

A preferred aminosilicone corresponding to formula (V) is the shown below in formula (VI):

(VI)

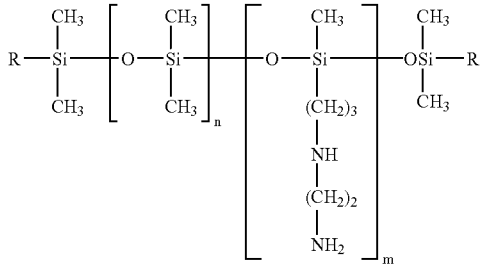

wherein R is independently selected from $C_1$ to $C_4$ alkyl, alkoxy, hydroxyalkyl and combinations thereof, preferably from methyl and methoxy and wherein n and m are hereinbefore defined. When both R groups are methyl, the above polymer is known as "trimethylsilylamodimethicone".

Most preferred amino silicones are those commercially available from Wacker, sold under the tradename of Wacker Belsil® ADM 1100 and Wacker Finish® WR 1100, and from General Electric sold as General Electric® SF 1923.

PREFERRED EMBODIMENTS OF THE SILICONE BLENDS

In a preferred embodiment of the present invention, the silicone blend comprises non-functionalized silicone having a viscosity from 0.55 $m^2/s$ (550,000 centistokes at 20° C.) to 0.7 $m^2/s$ (700,000 centistokes at 20° C.) in combination with a functionalized silicone having a % amine/ammonium functionality in the range from 0.3% to 0.5%. In this preferred embodiment, the weight ratio of the non-functionalized silicone to the functionalized silicone is from 15:1 to 2:1.

In another preferred embodiment of the present invention, the silicone blend is emulsified with an emulsifier. In general terms this means that the pre-formed blend of the non-functionalized silicone and functionalized silicone are emulsified. Such an emulsified blend is then added to the other ingredients to form the final liquid laundry detergent composition of the present invention. The weight ratio between the silicone blend and the emulsifier is generally between 1000:1 and 1:1000, preferably between 500:1 and 1:100, more preferably between 200:1 and 1:1, and most preferably between 20:1 and 5:1. Any emulsifier which is chemically and physically compatible with all other ingredients of the compositions of the present invention is suitable for use therein. However, cationic emulsifiers, nonionic emulsifiers and combinations thereof are preferred such as follows:

Cationic Emulsifiers:

Cationic emulsifiers suitable for use in the silicone blends of the present invention have at least one quaternized nitrogen and one long-chain hydrocarbyl group. Compounds comprising two, three or even four long-chain hydrocarbyl groups are also included. Examples of such cationic emulsifiers include alkyltrimethylammonium salts or their hydroxyalkyl substituted analogs, preferably compounds having the formula $R^1R^2R^3R^4N^+X^-$. $R^1$, $R^2$, $R^3$ and $R^4$ are independently selected from $C_1$-$C_{26}$ alkyl, alkenyl, hydroxyalkyl, benzyl, alkylbenzyl, alkenylbenzyl, benzylalkyl, benzylalkenyl and X is an anion. The hydrocarbyl groups $R^1$, $R^2$, $R^3$ and $R^4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R^2$, $R^3$ or $R^4$ should be benzyl. The hydrocarbyl groups $R^1$, $R^2$, $R^3$ and $R^4$ can independently comprise one or more, preferably two, ester—([—O—C(O)—]; [—C(O)—O—]) and/or an amido-groups ([O—N(R)—]; [—N(R)—O—]) wherein R is defined as $R^1$ above. The anion X may be selected from halide, methysulfate, acetate and phosphate, preferably from halide and methylsulfate, more preferably from chloride and bromide. The $R^1$, $R^2$, $R^3$ and $R^4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic emulsifiers comprising only one long hydrocarbyl chain, the preferred alkyl chain length for $R^1$ is $C_{12}$-$C_{15}$ and preferred groups for $R^2$, $R^3$ and $R^4$ are methyl and hydroxyethyl.

For cationic emulsifiers comprising two or three or even four long hydrocarbyl chains, the preferred overall chain length is $C_{18}$, though combinations of chainlengths having non-zero proportions of lower, e.g., $C_{12}$, $C_{14}$, $C_{16}$ and some higher, e.g., $C_{20}$ chains can be quite desirable.

Preferred ester-containing emulsifiers have the general formula $$\{(R_5)_2N((CH_2)_nER_6)_2\}^+X^-$$

wherein each $R_5$ group is independently selected from $C_{1-4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^-$ is a suitable anion, for example chloride, methosulfate and combinations thereof.

A second type of preferred ester-containing cationic emulsifiers can be represented by the formula: $\{(R_5)_3N(CH_2)_nCH(O(O)CR_6)CH_2O(O)CR_6\}^{+X-}$ wherein $R_5$, $R_6$, X, and n are defined as above. This latter class can be exemplified by 1,2 bis[hardened tallowoyloxy]-3-trimethylammonium propane chloride.

The cationic emulsifiers, suitable for use in the blends of the present invention can be either water-soluble, water-dispersable or water-insoluble.

Nonionic Emulsifiers:

For the selection of nonionic emulsifiers, reference is made to chapter "(a2) Nonionic Surfactants". All nonionic surfactants disclosed therein can also be used as nonionic emulsifiers. Furthermore, other suitable nonionic emulsifiers include alkyl poly glucoside-based emulsifiers such as those disclosed in U.S. Pat. No. 4,565,647, Llenado, issued Jan. 21, 1986, having a hydrophobic group containing from 6 to 30 carbon atoms, preferably from 8 to 16 carbon atoms, more preferably from 10 to 12 carbon atoms, and a polysaccharide, e.g. a polyglycoside, hydrophilic group containing from 1.3 to 10, preferably from 1.3 to 3, most preferably from 1.3 to 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

Preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and combinations thereof in which the alkyl groups contain from 6 to 30, preferably from 8 to 16, more preferably from 10 to 12 carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position. Compounds of this type and their use in detergent are disclosed in EP-B 0 070 077, 0 075 996, 0 094 118, and in WO 98/00498.

The emulsifier may also optionally be diluted with a solvent or solvent system before emulsification of the silicone blend. Typically, the diluted emulsifier is added to the pre-formed silicone blend. Suitable solvents can be aqueous or non-aqueous; and can include water alone or organic solvents alone and/or combinations thereof. Preferred organic solvents include monohydric alcohols, dihydric alcohols, polyhydric alcohols, ethers, alkoxylated ethers, low-viscosity silicone-containing solvents and combinations thereof. Preferred are glycerol, glycols, polyalkylene glycols such as polyalkylene glycols, dialkylene glycol mono $C_1$-$C_8$ ethers and combinations thereof. Even more preferred are diethylene glycol mono ethyl ether, diethylene glycol mono propyl ether, diethylene glycol mono butyl ether, and combinations thereof. Highly preferred are combinations of solvents, especially combinations of lower aliphatic alcohols such as ethanol, propanol, butanol, isopropanol, and/or diols such as 1,2-propanediol or 1,3-propanediol; or combinations thereof with dialkylene glycol mono $C_1$-$C_8$ ethers and/or glycols and/or water. Suitable monohydric alcohols especially include $C_1$-$C_4$ alcohols.

Particle Size:

The silicone blend, either emulsified or not emulsified, has an average silicone particle size of from 1 μm to 500 μm, preferably from 5 μm to 100 μm and more preferably from 10 μm to 50 μm. Particle size may be measured by means of a laser scattering technique, using a Coulter LS 230 Laser Diffraction Particle Size Analyser from Coulter Corporation, Miami, Fla., 33196, USA). Particle sizes are measured in volume weighted % mode, using the parameters mean and median. Another method for measuring the particle size is by means of a microscop, using a microscope manufactured by Nikon® Corporation, Tokyo, Japan; type Nikon® E-1000 (enlargement 700×).

C, Detergent builders, detersive enzymes, dye transfer inhibiting agents, and combinations thereof.

The liquid detergent compositions of the present invention must contain an additional laundry adjunct selected from detergent builders, detersive enzymes, dye transfer inhibiting agents, and combinations thereof.

C1, Detergent builder—The additional laundry adjunct of the present invention may comprise a detergent builder. If used, these builders are typically present at concentrations from 1.0% to 80%, preferably from 5.0% to 70%, and more preferably from 20% to 60%, by weight of the composition.

In general any known detergent detergent builder is useful herein, including inorganic types such as zeolites, layer silicates, and phosphates such as the alkali metal polyphosphates, and organic types including fatty acids, and especially alkali metal salts of citrate, 2,2-oxydisuccinate, carboxymethyloxysuccinate, nitrilotriacetate and the like. Phosphate-free, water-soluble organic builders which have relatively low molecular weight, e.g., below 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

Preferred are in particular $C_{12}$-$C_{18}$ saturated and/or unsaturated, linear and/or branched, fatty acids, but preferably combinations of such fatty acids. Highly preferred are combinations of saturated and unsaturated fatty acids, for example preferred is a combination of rape seed-derived fatty acid and $C_{16}$-$C_{18}$ topped whole cut fatty acids, or a combination of rape seed-derived fatty acid and a tallow alcohol derived fatty acid, palmitic, oleic, fatty alkylsuccinic acids, and combinations thereof. Further preferred are branched fatty acids of synthetic or natural origin, especially biodegradable branched types.

Combinations of any of these fatty acid builders can be advantageous to further promote solubility. It is known that lower chain length fatty acids promote solubility but this needs to be balanced with the knowledge that they are often malodorous, e.g., at chain lengths of $C_9$ and below.

While the term "fatty acid builder" is in common use, it should be understood and appreciated that, as formulated in the present detergents, the fatty acid is in at least partially neutralized to neutralized form, the counter-ions can typically be alkanolamines, sodium, potassium, alkanolammonium or combinations thereof. Preferably, the fatty acids are neutralized with alkanolamines such as Mono Ethanol Amine, and are fully soluble in the liquid matrix of the compositions herein.

Fatty acids are preferred builders in the compositions of the present invention.

C2, Enzymes—The laundry adjuncts may also comprise one or more detersive enzymes. Suitable detersive enzymes for use herein include: Proteases like subtilisins from *Bacillus* [e.g. *subtilis, lentus, licheniformis, amyloliquefaciens* (BPN, BPN'), *alcalophilus*,] e.g. Esperase®, Alcalase®, Everlase® and Savinase® (Novozymes), BLAP and variants [Henkel]. Further proteases are described in EP130756, WO91/06637, WO95/10591 and WO99/20726. Amylases (α and/or β) are described in WO 94/02597 and WO 96/23873. Commercial examples are Purafect Ox Am® [Genencor] and Termamyl®, Natalase®, Ban®, Fungamyl® and Duramyl® [all ex Novozymes]. Cellulases include bacterial or fungal cellulases, e.g. produced by *Humicola insolens*, particularly DSM 1800, e.g. 50 Kda and −43 kD [Carezyme®]. Also suitable cellulases are the EGIII cellulases from *Trichoderma longibrachiatum*. Suitable lipases include those produced by *Pseudomonas* and *Chromobacter* groups. Preferred are e.g. Lipolase$^R$, Lipolase Ultra$^R$, Lipoprime$^R$ and Lipex$^R$ from Novozymes. Also suitable are cutinases [EC 3.1.1.50] and esterases. Carbohydrases e.g. mannanase (U.S. Pat. No. 6,060,299), pectate lyase (WO99/27083) cyclomaltodextringlucanotransferase (WO96/33267) xyloglucanase (WO99/02663). Bleaching enzymes eventually with enhancers include e.g. peroxidases, laccases, oxygenases, (e.g. catechol 1,2 dioxygenase, lipoxygenase (WO 95/26393), (non-heme) haloperoxidases.

It is common practice to modify wild-type enzymes via protein/genetic engineering techniques in order to optimize their performance in the detergent compositions. If used, these enzymes are typically present at concentrations from 0.0001% to 2.0%, preferably from 0.0001% to 0.5%, and more preferably from 0.005% to 0.1%, by weight of pure enzyme (weight % of composition).

Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds [e.g. certain esters, dialkyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl)serine salts; (meth)acrylic acid-(meth)acrylic acid ester copolymer and PEG; lignin compound, polyamide oligomer, glycolic acid or its salts; poly hexamethylene bi guanide or N,N-bis-3-amino-propyl-dodecyl amine or salt; and combinations thereof.

In liquid matrix of the compositions of the present invention, the degradation by the proteolytic enzyme of second enzymes can be avoided by protease reversible inhibitors [e.g. peptide or protein type, in particular the modified subtilisin inhibitor of family VI and the plasminostrepin; leupeptin, peptide trifluoromethyl ketones, peptide aldehydes.

C3, Dye transfer inhibiting agents—The laundry adjuncts may also comprise one or more materials effective for inhibiting the transfer of dyes from one fabric to another. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and combinations thereof. If used, these agents typically are present at concentrations from 0.01% to 10%, preferably from 0.01% to 5%, and more preferably from 0.05% to 2%, by weight of the composition.

More specifically, the polyamine N-oxide polymers preferred for use herein contain units having the following structural formula: R-$A_x$-Z; wherein Z is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

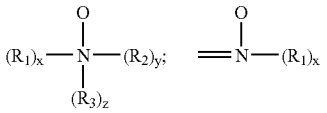

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and combinations thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the present compositions and processes for carrying out domestic laundry herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present compositions also may employ a polyvinylpyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

D, Coacervate Phase-Forming Polymer and of any Cationic Deposition Aid

The liquid laundry detergent compositions of the present invention must be essentially free of any coacervate phase-forming polymer and any cationic deposition aid. Essentially free means less than 0.01%, preferably less than 0.005%, more preferably less than 0.001% by weight of the composition, and most preferably completely or totally free of any coacervate phase-forming polymer and of any cationic deposition aid.

For purposes of this invention, a coacervate phase-forming polymer is any polymer material which will react, interact, complex or coacervate with any of the composition components to form a coacervate phase. The phrase "coacervate phase" includes all kinds of separated polymer phases known by the person skilled in the art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are fully described in "Interfacial Forces in Aqueous Media", C. J. van Oss, Marcel Dekker, 1994, pages 245 to 271. When using the phrase "coacervate phase", it should be understood that such a term is also occasionally referred to as "complex coacervate phase" or as "associated phase separation" in the literature.

Also for purpose of this invention, a cationic deposition aid is a polymer which has cationic, functional substituents and which serve to enhance or promote the deposition onto fabrics of one or more fabric care agents during laundering operations. Many but not all cationic deposition aids are also coacervate phase-forming polymers. Whether or not a cationic deposition aid forms a coacervate or whether or not a coacervate phase-forming polymer acts as a deposition aids, neither of these two polymer types can be significantly present in the detergent compositions of this invention.

Typical coacervate phase-forming polymers and any cationic deposition aids are homopolymers or be formed from two or more types of monomers. The molecular weight of the polymer will generally be between 5,000 and 10,000,000, typically at least 10,000 and more typically in the range 100,000 to 2,000,000. Coacervate phase-forming polymers and cationic deposition aids typically have cationic charge densities of at least 0.2 meq/gm at the pH of intended use of the composition, which pH will generally range from pH 3 to pH 9, more generally between pH 4 and pH 8. The excluded or minimized coacervate phase-forming polymers and any cationic deposition aids are typically of natural or synthetic origin and selected from the group consisting of substituted and unsubstituted polyquatemary ammonium compounds, cationically modified polysaccharides, cationically modified (meth)acrylamide polymers/copolymers, cationically modified (meth)acrylate polymers/copolymers, chitosan, quatemized vinylimidazole polymers/copolymers, dimethyldiallylammonium polymers/copolymers, polyethylene imine based polymers, cationic guar gums, and derivatives thereof and combinations thereof.

These polymers may have cationic nitrogen containing groups such as quaternary ammonium or protonated amino groups, or a combination thereof. The cationic nitrogen-containing group are generally be present as a substituent on a fraction of the total monomer units of the cationic polymer. Thus, when the polymer is not a homopolymer it will frequently contain spacing non-cationic monomer units. Such polymers are described in the CTFA Cosmetic Ingredient Directory, $7^{th}$ edition.

Non-limiting examples of excluded or minimized coacervate phase-forming cationic polymers include copolymers of vinyl monomers having cationic protonated amine or quaternary ammonium functionalities with water soluble spacer monomers such as acrylamide, methacrylamide, alkyl and dialkyl acrylamides, alkyl and dialkyl methacrylamides, alkyl acrylate, alkyl methacrylate, vinyl caprolactone and vinyl pyrrolidine. The alkyl and dialkyl substituted monomers typically have $C_1$-$C_7$ alkyl groups, more typically $C_1$-$C_3$ alkyl groups. Other spacers include vinyl esters, vinyl alcohol, maleic anhydride, propylene glycol and ethylene glycol.

Other excluded or minimized coacervate phase-forming cationic polymers include, for example: a) copolymers of 1-vinyl-2-pyrrolidine and 1-vinyl-3-methyl-imidazolium salt (e.g. chloride alt), referred to in the industry by the Cosmetic, Toiletry, and Fragrance Association, (CTFA) as Polyquaternium-16. This material is commercially available from BASF Wyandotte Corp. under the LUVIQUAT tradenname (e.g. LUVIQUAT FC 370); b) copolymers of 1-vinyl-2-pyrrolidine and dimethylaminoethyl methacrylate, referred to in the industry (CTFA) as Polyquaternium-11. This material is available commercially from Graf Corporation (Wayne, N.J., USA) under the GAFQUAT tradename (e.g. GAFQUAT 755N); c) cationic diallyl quaternary ammonium-containing polymers including, for example, dimethyldiallylammonium chloride homopolymer and copolymers of acrylamide and dimethyldiallylammonium chloride, reffered to in the industry (CTFA) as Polyquaternium 6 and Polyquaternium 7, respectively; d) mineral acid salts of amino-alkyl esters of homo- and copolymers of unsaturated carboxylic acids having from 3 to 5 carbon atoms as describes in U.S. Pat. No. 4,009,256; e) amphoteric copolymers of acrylic acid including copolymers of acrylic acid and dimethyldiallylammonium chloride (referred to in the industry by CTFA as Polyquaternium 22), terpolymers of acrylic acid with dimethyldiallylammonium chloride and acrylamide (referred to in the industry by CTFA as Polyquaternium 39), and terpolymers of acrylic acid with methacrylamidopropyl trimethylammonium chloride and methylacrylate (referred to in the industry by CTFA as Polyquaternium 47).

Other excluded or minimized coacervate phase-forming polymers and any cationic deposition aids include cationic polysaccharide polymers, such as cationic cellulose and derivatives thereof, cationic starch and derivatives thereof, and cationic guar gums and derivatives thereof.

Cationic polysaccharide polymers include those of the formula:

$$A\text{-}O\text{—}[R\text{—}N^+(R^1)(R^2)(R^3)]X^-$$

wherein A is an anhydroglucose residual group, such as a starch or cellulose anhydroglucose residual, R is an alkylene, oxyalkylene, polyoxyalkylene, or hydroxyalkylene group, or combination thereof; and $R^1$, $R^2$, and $R^3$ independently represent alkyl, aryl, alkylaryl, arylalkyl, alkoxyalkyl, or alkoxyaryl, each group comprising up to 18 carbon atoms. The total number of carbon atoms for each cationic moiety (i.e. the sum of carbon atoms in $R^1$, $R^2$, and $R^3$) is typically 20 or less, and X is an anionic counterion as described hereinbefore.

A particular type of commercially utilized cationic polysaccharide polymer is a cationic guar gum derivative, such as the cationic polygalactomannan gum derivatives described in U.S. Pat. No. 4,298,494, which are commercially available from Rhone-Poulenc in their JAGUAR tradename series. An example of a suitable material is hydroxypropyltrimonium chloride of the formula:

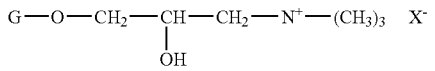

where G represents guar gum, and X is an anionic counterion as described hereinbefore, typically chloride. Such a material is available under the tradename of JAGUAR C-13-S. In JAGUAR C-13-S the cationic charge density is 0.7 meq/gm. Similar cationic guar gums are also available from AQUALON under the tradename of N-Hance® 3196 and Galactosol® SP813S.

Reference is made to "Principles of Polymer Science and Technology in Cosmetics and Personal Care" by Goddard and Gruber and in particular to pages 260-261, where an additional list of synthetic cationic polymers to be excluded or minimized can be found.

E, Optional Composition Components

The present compositions may optionally comprise one or more optional composition components, such as liquid carriers, suds suppressors, optical brighteners, stabilizers, coupling agents, fabric substantive perfumes, chelating agents, cationic nitrogen-containing detersive surfactants, pro-perfumes, bleaches, bleach activators, bleach catalysts, enzyme stabilizing systems, soil release polymers, dispersants or polymeric organic builders including water-soluble polyacrylates, acrylate/maleate copolymers and the like, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

Process for Preparing the Liquid Detergent Composition

The liquid detergent compositions of the present invention can be prepared in any suitable manner and can, in general, involve any order of combining or addition as known by the person skilled in the art.

Method of Treating Non-Keratinous Substrates and Uses of Compositions of the Invention in Relation to Form The term "non-keratinous substrates" as used herein means a textile substrate, preferably a fiber, more preferably a fabric or a garment, susceptible of having one or more of the fabric care benefits described herein imparted thereto by a composition of the present invention. Keratinous substrates, such as hair and fur of humans and/or other animals, are expressly excluded. Even tough it is understand that under specific circumstances, substrates such a wool and silk can be considered as being keratinous, for the purpose of this invention, the term "non-keratinous substrates" includes these two specific substrates.

The amount of silicone deposited is preferably at least 0.001 mg silicone per gram of non-keratinous substrate, more preferably between 0.1 mg silicone per gram of non-keratinous substrate and 500 mg silicone per gram of non-keratinous substrate, even more preferably between 0.125 mg silicone per gram of non-keratinous substrate and 10 mg silicone per gram of non-keratinous substrate, and most preferably between 0.150 mg silicone per gram of non-keratinous substrate and 1.0 mg silicone per gram of non-keratinous substrate. The amounts of silicone blend deposited may be measured by means of a X-ray fluorescence spectrometry, using a X-Ray Fluorescence Spectroscope PW 2404 from Philips Electronics N.V., The Netherlands.

EXAMPLES

The following non-limiting examples are illustrative of the present invention. Percentages are by weight unless otherwise specified.

For purposes of this invention, viscosity is measured with a Carrimed CSL2 Rheometer at a shear rate of 21 $s^{-1}$.

Particle size measurements were conducted using a Coulter LS 230 Laser Diffraction Particle Size Analyser from Coulter Corporation, Miami, Fla., 33196, USA) or via microscopy using a microscope manufactured by Nikon® Corporation, Tokyo, Japan; type Nikon® E-1000 (enlargement 700×). Particle sizes are measured in volume weighted % mode, using the parameters mean and median.

EXAMPLES

The final liquid laundry detergent composition is formulated by combining a pre-formed silicone blend, which is optionally emulsified with an emulsifier, with at least one surfactant and further at least one additional non-silicone laundry adjunct. The surfactant and the laundry adjunct may optionally pre-mixed prior to combination with the, optionally emulsified, pre-formed silicone blend.

Fabric Cleaning Premixes A1 and A2 and A3:

| | wt % (raw materials at 100% activity) | | |
|---|---|---|---|
| | A1 | A2 | A3 |
| $C_{13}$-$C_{15}$ alkylbenzene sulphonic acid | 13.0 | 5.5 | 5.5 |
| $C_{12}$-$C_{15}$ alkyl ethoxy (1.1 eq.) sulphate | | 13.0 | 13.0 |
| $C_{14}$-$C_{15}$ EO8 (1) | 9.0 | — | — |

-continued

| | wt % (raw materials at 100% activity) | | |
|---|---|---|---|
| | A1 | A2 | A3 |
| $C_{12}$-$C_{13}$ EO9 (2) | — | 2.0 | 2.0 |
| $C_{12}$-$C_{14}$ alkyl dimethyl amineoxide (3) | 1.5 | 1.0 | 1.0 |
| $C_{12}$-$C_{18}$ fatty acid | 10.0 | 2.0 | 2.0 |
| Citric acid | 4.0 | 4.0 | 4.0 |
| Diethylene triamine pentamethylene phosphonic acid | 0.3 | — | — |
| Hydroxyethane dimethylene phosphonic acid | 0.1 | — | — |
| Ethoxylated polyethylene imine | 1.0 | 1.0 | 1.0 |
| Ethoxylated tetraethylene pentamine | 1.0 | 0.5 | 0.5 |
| Di Ethylene Triamine Penta acetic acid | — | 0.5 | 0.5 |
| Ethoxysulphated hexamethylene diamine quat | — | 1.0 | 1.0 |
| Fluorescent whitening agent | 0.15 | 0.15 | 0.15 |
| $CaCl_2$ | 0.02 | 0.02 | 0.02 |
| Propanediol | 5.0 | 6.5 | 6.5 |
| Ethanol | 2.0 | 2.0 | 2.0 |
| Sodium cumene sulphonate | 2.0 | — | — |
| NaOH | to pH 7.8 | to pH 8.0 | to pH 8.0 |
| Protease enzyme | 0.75 | 0.75 | 0.75 |
| Amylase enzyme | 0.20 | 0.20 | 0.20 |
| Cellulase enzyme | 0.05 | — | — |
| Boric acid | 2.0 | 0.3 | — |
| Na-Borate | — | — | 1.5 |
| Poly(N-vinyl-2-pyrrolidone)-poly(N-vinyl-imidazol) (MW: 35,000) | 0.1 | — | — |
| Tinopal ®-AMS-GX | — | 1.2 | — |
| Hydrogenated castor oil | 0.2 | 0.3 | 0.3 |
| Dye | 0.001 | 0.001 | 0.001 |
| Perfume | 0.70 | 0.70 | 0.70 |
| Water | Balance | Balance | Balance |

(1) Marlipal 1415/8.1 ex Sasol
(2) Neodol 23-9 ex Shell
(3) $C_{12}$-$C_{14}$ alkyl dimethyl amineoxide ex P&G, supplied as a 31% active solution in water Silicone Blends B1 to B4:

Preparation of the silicone blend (blend B1): 15.0 g of GE® SF 1923 are added to 45.0 g of PDMS 0.6 $m/s^2$ (600,000 centistokes at 20° C.; GE® Visc-600M) and mixed with a normal laboratory blade mixer (type: IKA Labortechnik Eurostar power control-visc lab mixer) for at least 1 hour.

Preparation of the silicone blend (blend B2): 15.0 g of Wacker Finish® WR 1100 are added to 45.0 g of PDMS 0.6 $m/s^2$ (600,000 centistokes at 20° C.; GE® Visc-600M) and mixed with a normal laboratory blade mixer (type: IKA Labortechnik Eurostar power control-visc lab mixer) for at least 1 hour.

5.0 g Neodol 23-9 ex Shell ($C_{12}$-$C_{13}$ EO9 nonionic emulsifer), which is stored at 35° C., is added to 25 g of demineralized water at 35° C. and stirred for 15 min with a normal laboratory blade mixer (type: IKA Labortechnik Eurostar power control-visc lab mixer).

17.1 g of the Neodol 23-9 ex Shell+water combination is added to 40.0 g of the Wacker Finish® WR 1100+PDMS 0.6$m/s^2$ blend. The combination is stirred for 45 min at low speed (200 RPM) using a normal laboratory blade mixer (type: IKA Labortechnik Eurostar power control-visc lab mixer).

Preparation of the silicone blend (blend B3): 15.0 g of Wacker Finish® WR 1100 are added to 45.0 g of PDMS 0.6 $m/s^2$ (600,000 centistokes at 20° C.; GE® Visc-600M) and mixed with a normal laboratory blade mixer (type: IKA labortechnik Eurostar power control-visc lab mixer) for at least 1 hour.

0.7 g of Plantaren 2000 N UP alkylpolyglucoside surfactant ex-Cognis Corporation (50% active) is added to 29.3 g of demineralized water and stirred for 15 min with a normal laboratory blade mixer (type: IKA Labortechnik Eurostar power control-visc lab mixer).

17.1 g of the Plantaren 2000 N UP alkylpolyglucoside+water combination is added to 40.0 g of the Wacker Finish® WR 1100+PDMS 0.6m/s$^2$ blend. The combination is stirred for 45 min at low speed (200 RPM) using a normal laboratory blade mixer (type: IKA Labortechnik Eurostar power control-visc lab mixer).

Preparation of the silicone blend (blend B4): 30.0 g of GE® SF 1923 are added to 30.0 g of PDMS 0.6 m/s$^2$ (600,000 centistokes at 20° C.; GE® Visc-600M) and mixed with a normal laboratory blade mixer (type: IKA Labortechnik Eurostar power control-visc lab mixer) for at least 1 hour.

12.5 g of $C_{12}$-$C_{14}$ dimethyl(hydroxyethyl)ammonium chloride ex-Clariant (40% active) is added to 50 g of the GE® SF 1923+PDMS 0.6m/s$^2$ blend. The combination is stirred for 30 min using a normal laboratory blade mixer (type: IKA Labortechnik Eurostar power control-visc lab mixer). 37.5 g of demineralized water is then added and the combination is stirred for another 45 min at low speed (200 RPM) using a normal laboratory blade mixer (type: IKA Labortechnik Eurostar power control-visc lab mixer).

Final Detergent Compositions

Combination of the two premixes A1 & B1 (entry 1) or A1 & B2 (entry 2) or A1 & B3 (entry 3) or A1 & B4 (entry 4) or A2 & B1 (entry 5) or A2 & B2 (entry 6) or A2 & B3 (entry 7) ir A2 & B4 (entry 8) or A3 & B1 (entry 9) or A3 & B2 (entry 10) or A3 & B3 (entry 11) or A3 & B4 (entry 12) to form the final liquid laundry detergent composition:

30.0 g of premix B1 is added to 1500 g of either premixes A1 or A2 or A3 and stirred for 30 min at 500 RPM with a normal laboratory blade mixer.

42.9 g of either premix B2 or B3 or B4 are added to 1500 g of either premixes A1 or A2 or A3 and stirred for 15 minutes at 300 RPM with a normal laboratory blade mixer.

For all blends B1, B2, B3 or B4, the mean particle size in the A1, A2 or A3 products is in the 10 μm-50 μm range.

The liquid laundry detergent compositions of composition entries 1 to 12 all demonstrate excellent product stability as fully formulated composition as well as in diluted form during a laundering cycle. The liquid laundry detergent compositions of composition entries 1 to 12 all provide excellent fabric cleaning and fabric care performance when added to the drum of an automatic washing machine wherein fabric are there and thereinafter laundered in conventional manner.

The reduced whiteness observed in the presence of any cationic deposition aids and in the presence of any coacervate phase-forming polymer is significantly reduced, preferably eliminated. Good color maintenance performance with minimal dye transfer is observed when utilizing the compositions of the present invention; especially with.

The compositions of entries 1 to 12 are particularly advantageous with respect to fabric softening benefits imparted to fabrics treated therewith; this is especially true for colored fabrics on which the observed fabric softening benefits are even more enhanced in comparison to the fabric softening benefits provided onto white fabrics. The compositions of examples entries 1, 2, 3, 10, 11, and 12 are also advantageous with respect to anti-abrasion benefits and to anti-pilling benefits provided for fabrics treated therewith. The compositions of entries 1, 2, 3, 10, 11, and 12 are particularly advantageous with respect to color care benefits imparted to fabrics treated therewith.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous liquid laundry detergent composition for treating non-keratinous substrates under domestic wash conditions, said composition comprising:

(A) from 10% to 80%, by weight of the composition, of at least one surfactant selected from the group consisting of anionic surfactants, nonionic surfactants, zwitterionic surfactants, amphoteric surfactants, and combinations thereof;

(B) from 0.05% to 10%, by weight of the composition, of a silicone blend comprising a non-functionalized silicone and a functionalized silicone, wherein the non-functionalized silicone is a nonionic, non-cross linked, nitrogen-free silicone polymer and the functionalized silicone is an amino-functionalized silicone polymer;

(C) a dye transfer inhibiting agent and optionally a detergent builder and (D) detersive enzyme;

wherein the composition is free of any coacervate phase-forming polymer and free of any cationic deposition aid.

2. An aqueous liquid laundry detergent composition according to claim 1 wherein the non-functionalized silicone has a viscosity from 0.01 m$^2$/s (10,000 centistokes at 20° C.) to 2.0 m$^2$/s (2,000,000 centistokes at 20° C.).

3. An aqueous liquid laundry detergent composition according to claim 1 wherein the functionalized silicone has a % amine/ammonium functionality in the range of from 0.01% to 10%.

4. An aqueous liquid laundry detergent composition according to claim 3 wherein the functionalized silicone has a % amine/ammonium functionality in the range of from 0.05% to 0.3%.

5. An aqueous liquid laundry detergent composition according to claim 1 wherein the functionalized silicone has a viscosity from 0.0001 m$^2$/s (100 centistokes at 20° C.) to 2.0 m$^2$/s (2,000,000 centistokes at 20° C.).

6. An aqueous liquid laundry detergent composition according to claim 1 wherein within the silicone blend the non-functionalized silicone and the functionalized silicone are present in a weight ratio of from 100:1 to 1:100.

7. An aqueous liquid laundry detergent composition according to claim 1 wherein the silicone blend is emulsified with an emulsifier.

8. An aqueous liquid laundry detergent composition according to claim 7 wherein the emulsifier is selected from the group consisting of cationic emulsifiers, nonionic emulsifiers and combinations thereof.

9. An aqueous liquid laundry detergent composition according to claim 1 wherein the silicone blend has an average particle size of from 1 μm to 500 μm.

10. An aqueous liquid laundry detergent composition according to claim 1 further comprising at least one stabilizer selected from crystalline, hydroxyl-containing stabilizing agents.

11. An aqueous liquid laundry detergent composition for treating non-keratinous substrates under domestic wash conditions, said composition comprising:

(A) from 10% to 80% by weight of the composition, of at least one surfactant selected from the group consisting of anionic surfactants, nonionic surfactants, zwitterionic surfactants, amphoteric surfactants, and combinations thereof;

(B) from 0.25% to 3.0% by weight of the composition, of a silicone blend comprising a non-functionalized silicone and a functionalized silicone; and (C) a dye transfer inhibiting agent and optionally a detergent builder; and (D) detersive enzyme;

wherein the composition is free of any coacervate phase-forming polymer and of any cationic deposition aid;

wherein the non-functionalized silicone is a nonionic, non-cross linked, nitrogen-free silicone polymer, having a viscosity from 0.55 $m^2/s$ (550,000 centistokes at 20° C.) to 0.7 $m^2/s$ (700,000 centistokes at 20° C.);

wherein the functionalized silicone is an amino-functionalized silicone polymer having a % amine/axnznonium functionality in the range of from 0.05% to 1% and a viscosity from 0.02 $m^2/s$ (20,000 centistokes at 20° C.) to 0.08 $m^2/s$ (80,000 centistokes at 20° C.);

wherein within the silicone blend the non-functionalized silicone and the functionalized silicone are present in a weight ratio of from 15:1 to 2:1; and wherein the silicone blend is emulsified with a cationic and/or nonionic emulsifier.

12. Non-keratinous substrate treated with an aqueous liquid laundry detergent composition according to claim 1 wherein on such a treated non-keratinous substrate a certain amount of the silicone blend provided by the liquid laundry detergent composition of the present invention, has been deposited, wherein the amount of silicone deposited is at least 0.001 mg silicone per gram of non-keratinous substrate.

13. An aqueous liquid laundry detergent composition according to claim 1 wherein within the silicone blend the non-functionalized silicone and the functionalized silicone are present in a weight ratio of from 15:1 to 2:1.

14. An aqueous liquid laundry detergent composition according to claim 1 wherein the composition comprises at least one anionic surfactant.

15. An aqueous liquid laundry detergent composition according to claim 11 wherein the composition comprises from 10% to 80% by weight of the composition at least one anionic surfactant.

16. An aqueous liquid laundry detergent composition according to claim 11 wherein the functionalized silicone is an amino-functionalized silicone polymer having a % anime/ammonium functionality in the range of from 0.05% to 0.3%.

17. An aqueous liquid laundry detergent composition for treating non-keratinous substrates under domestic wash conditions said composition comprising:

(A) at least one anionic surfactant;

(B) from 0.05% to 10%, by weight of the composition, of a silicone blend comprising a non-functionalized silicone and a functionalized silicone, wherein the non-functionalized silicone is a non-cross linked, nitrogen-free silicone polymer and the functionalized silicone is an amino functionalized silicone polymer;

(C) a dye transfer inhibiting agent and optionally a detergent builder; and (D) detersive enzyme;

wherein the composition is free of any coacervate phase-forming polymer and free of any cationic deposition aid.

* * * * *